US007677907B2

(12) United States Patent
Guan et al.

(10) Patent No.: US 7,677,907 B2
(45) Date of Patent: Mar. 16, 2010

(54) CARD EDGE CONNECTOR WITH A METALLIC REINFORCEMENT PIECE

(75) Inventors: Hai-Fei Guan, Kunshan (CN); Xue-Wu Bu, Kunshan (CN); Ting-Shun Liu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/075,145

(22) Filed: Mar. 10, 2008

(65) Prior Publication Data

US 2008/0220642 A1 Sep. 11, 2008

(30) Foreign Application Priority Data

Mar. 9, 2007 (CN) ..... 2007 2 0035284

(51) Int. Cl.
*H01R 13/62* (2006.01)

(52) U.S. Cl. ..... 439/157; 439/160; 439/326

(58) Field of Classification Search ..... 439/157, 439/160, 328, 325
See application file for complete search history.

(56) References Cited

U.S. PATENT DOCUMENTS 5,413,497 A * 5/1995 Lwee ..... 439/328
5,632,640 A 5/1997 Noda et al.
5,997,331 A * 12/1999 Tu ..... 439/328
6,146,177 A 11/2000 Wu et al.
7,048,565 B2 5/2006 Lin et al.
7,074,067 B2 * 7/2006 Yang et al. ..... 439/326
7,252,523 B1 * 8/2007 Pennypacker et al. ..... 439/160

* cited by examiner

*Primary Examiner*—Hae Moon Hyeon
(74) *Attorney, Agent, or Firm*—Wei Te Chung; Andrew C. Cheng; Ming Chieh Chang

(57) ABSTRACT

A card edge connector (100) for receiving a module (200), includes an insulative housing (1) having a receiving slot (12) for receiving the module and a pair of arm portions (10) located at opposite ends thereof. Each arm portion has a pair of side walls (15) and a resilient arm (16) with a retaining embossment (162) for locking the module. The side walls are integrally formed on the insulative housing and include a projection (157). A number of terminals (2) are mounted on said insulative housing and extend into the receiving slot thereof. A pair of latches (3) are attached to the arm portions and move with the resilient arms. Each latch includes a base (31) and a stopping plate (37) extending from the base. The stopping plates engage with said projections of the side walls thereby open said resilient arms when the module detaches from the card edge connector.

19 Claims, 4 Drawing Sheets

CARD EDGE CONNECTOR WITH A METALLIC REINFORCEMENT PIECE

BACKGROUND OF THE INVENTION

1. Field of the Invention

The present invention generally relates to a card edge connector for receiving a module and more particularly to a card edge connector having a latch for removing the module from the connector.

2. Description of Related Art

A conventional card edge connector is fixed in an electronic device such as a computer for receiving a memory module. Such connector is mounted on a printed circuit board (PCB), and comprises an elongated insulative housing, a plurality of terminals received therein and a pair of metal latches attached thereto. The insulative housing has a slot for receiving the memory module and a pair of side frames on two lateral sides thereof. Each side frame includes a buckling arm for locking the memory module. The latches are individually mounted on free ends of the side frames. Each latch has an elongated main portion, a restrictive body extending upwardly from an inner side of the main portion for restraining the inward movement of the side frame and a resilient arm extending from the upper surface of the main portion. The resilient arm extends along an outside face of the side frame and further has a stopping plate. The stopping plate is folded inwardly from the resilient arm and formed by further bending downwardly. The stopping plate is disposed at a proper position for limiting the movement of the restrictive body. When the memory module is removed from the slot of the insulative housing, the two side frames can be moved outwardly to release the embossment, which has been secured the memory module. The two side frames push the resilient arms outwardly in order to move the stopping plates to abut against the restrictive bodies for an orientation. Therefore, the side frames will not over extend in order to prevent breakage or deformation thereof since each side frame is only capable of moving a distance dictated by the distance between the restrictive body and the stopping plate.

However, the stopping plate and the restrictive bodies are integrally formed on the latch which results in the complexity of the latch structure and will increase the manufacturing costs. Furthermore, the movement and the vibration of the resilient arm will lead to breakage or deformation between the resilient arm and the main portion thereof.

Hence, an improvement over the prior art is required to overcome the problems thereof.

SUMMARY OF THE INVENTION

According one aspect of the present invention, a card edge connector for receiving a module, comprises an insulative housing having a receiving slot for receiving the module and a pair of arm portions located at opposite ends thereof. Said arm portion has a pair of side walls and a resilient arm with a retaining embossment for locking the module. The side walls are integrally formed on the insulative housing and include a projection. A plurality of terminals are mounted on said insulative housing and extend into the receiving slot thereof. A pair of latches are attached to the arm portions and move with the resilient arms. Each latch includes a base and a stopping plate extending from the base. The stopping plates engage with said projections of the side walls thereby open said resilient arms when the module detaches from the card edge connector.

According to another aspect of the present invention, a card edge connector comprises an elongated insulative housing having a pair of arm portions at opposite ends thereof. Each arm portion has a pair of side walls defining a retaining slot for receiving a module therein, and a resilient arm located between the side walls. The resilient arm comprises a retaining embossment for locking the module. A plurality of terminals are assembled to the insulative housing. A pair of metal latches are attached to the arm portions and each has a base and a pair of positioning portions at opposite sides thereof for fixing to the corresponding arm portion. Each latch has a gripping portion at a top end thereof for urging the corresponding resilient arm.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
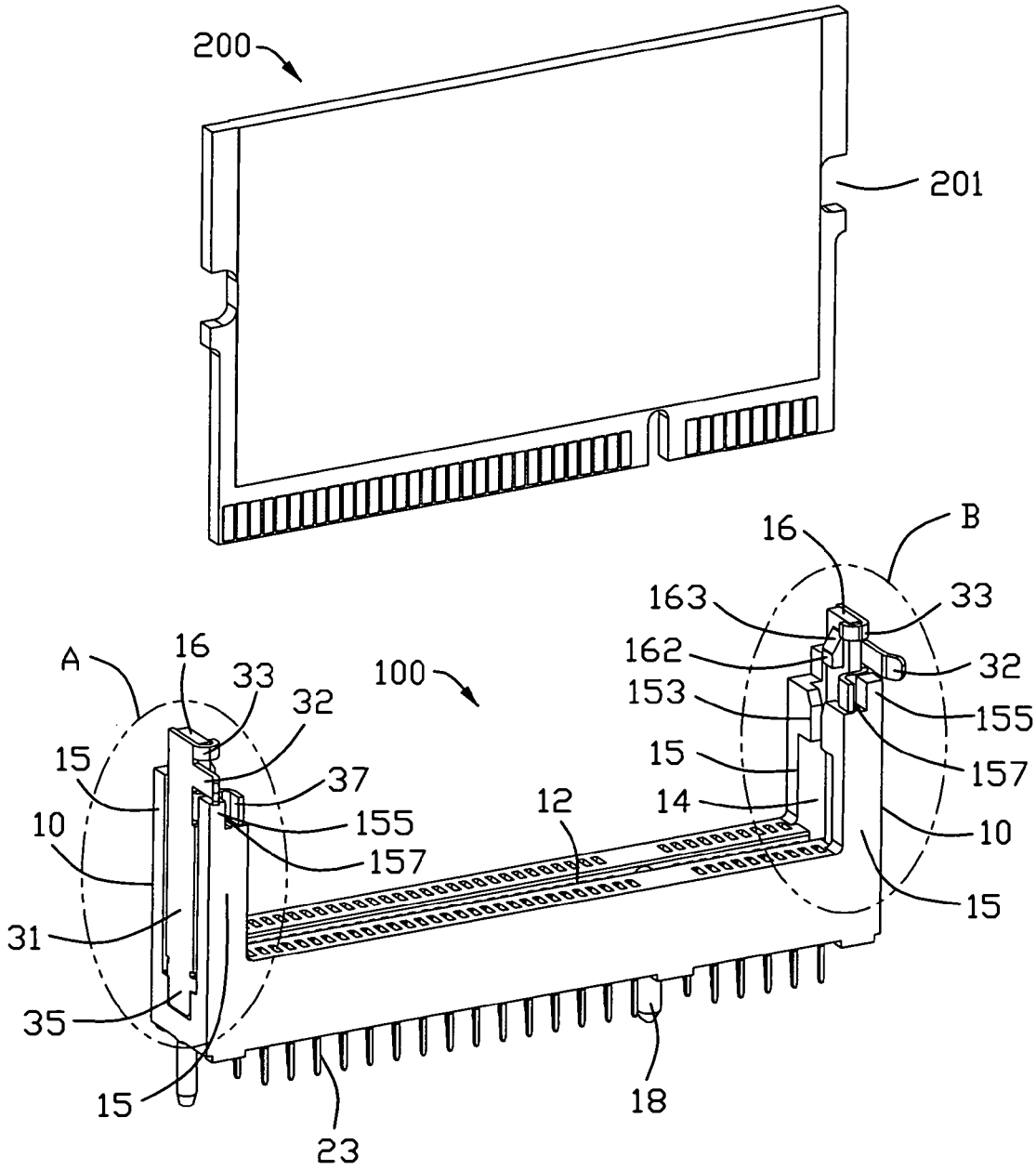
FIG. 1 is a perspective view of a card edge connector and a memory module to be received therein according to the present invention.

Reference will now be made to the drawing figures to describe the preferred embodiment of the present invention in detail.

Figure 2:
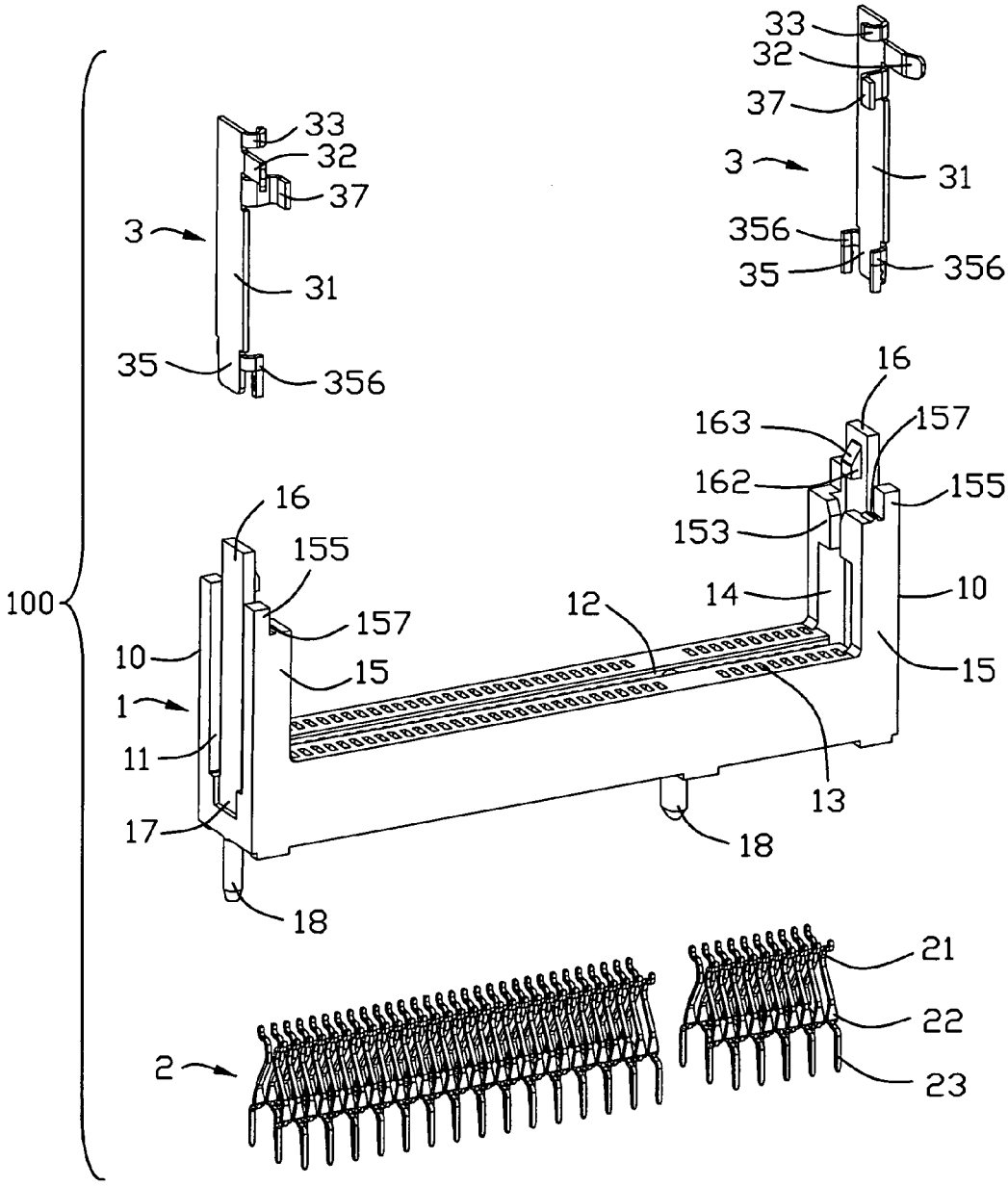
FIG. 2 is an exploded view of the card edge connector shown in FIG. 1.

Referring to FIGS. 1 and 2, the card edge connector 100 according to the present invention, mounted on a mother printed circuit board (PCB), comprises an elongated insulative housing 1, a plurality of terminals 2 assembled to the insulative housing 1 and a pair of latches 3 attached to the insulative housing 1. The insulative housing 1 is made of plastic materials, and has a central receiving slot 12 formed along a longitudinal direction thereof for receiving a memory module 200 and two rows of terminal cavities 13 disposed on opposite sides of the receiving slot 12 for retaining the terminals 2 therein. A pair of arm portions 10 extends upwardly from opposite ends of the insulative housing 1. Each arm portion 10 includes a pair of side walls 15 and a resilient arm 16 located therebetween. The side walls 15 and the resilient arm 16 are integrally formed on the insulative housing 1. In another alternative embodiment according to the invention, the resilient arms 16 could be assembled to opposite ends of the insulative housing 1. Each arm portion 10 defines a slot 17 on outside of the resilient arm 16. A pair of slits 11 are formed between each side wall 15 and the resilient arm 16. The resilient arm 16 has a free end capable of moving inwardly and outwardly. A retaining embossment or locking head 162 is defined on the inner side of the free end for locking the module 200 and has an inclined face 163 for facilitating the insertion of the memory module 200. A retaining slot or passage 14 communicating with the receiving slot 12 is formed between the pair of side walls 15, and each side wall 15 has a project portion 153 protruding into the retaining slot 14 for sandwiching the memory module 200. The project portion 153 is located inside the resilient arm 16 to limit movement of the memory module 200. One of the side walls 15 comprises a projection 157 and a limiting portion 155 on a top surface thereof for limiting an outer movement of the resilient arm 16. The insulative housing 1 further has a pair of posts 18 extending downwardly from a bottom surface thereof.

Each terminal 2 includes a contact portion 21 extending into the receiving slot 12 for engaging with a plurality of conductive pads on opposite sides of the memory module 200, a tail portion 23 projecting out of the insulative housing 1 for connection to the printed circuit board, and a connection portion 22 engaging with the terminal cavity 13.

Figure 3:
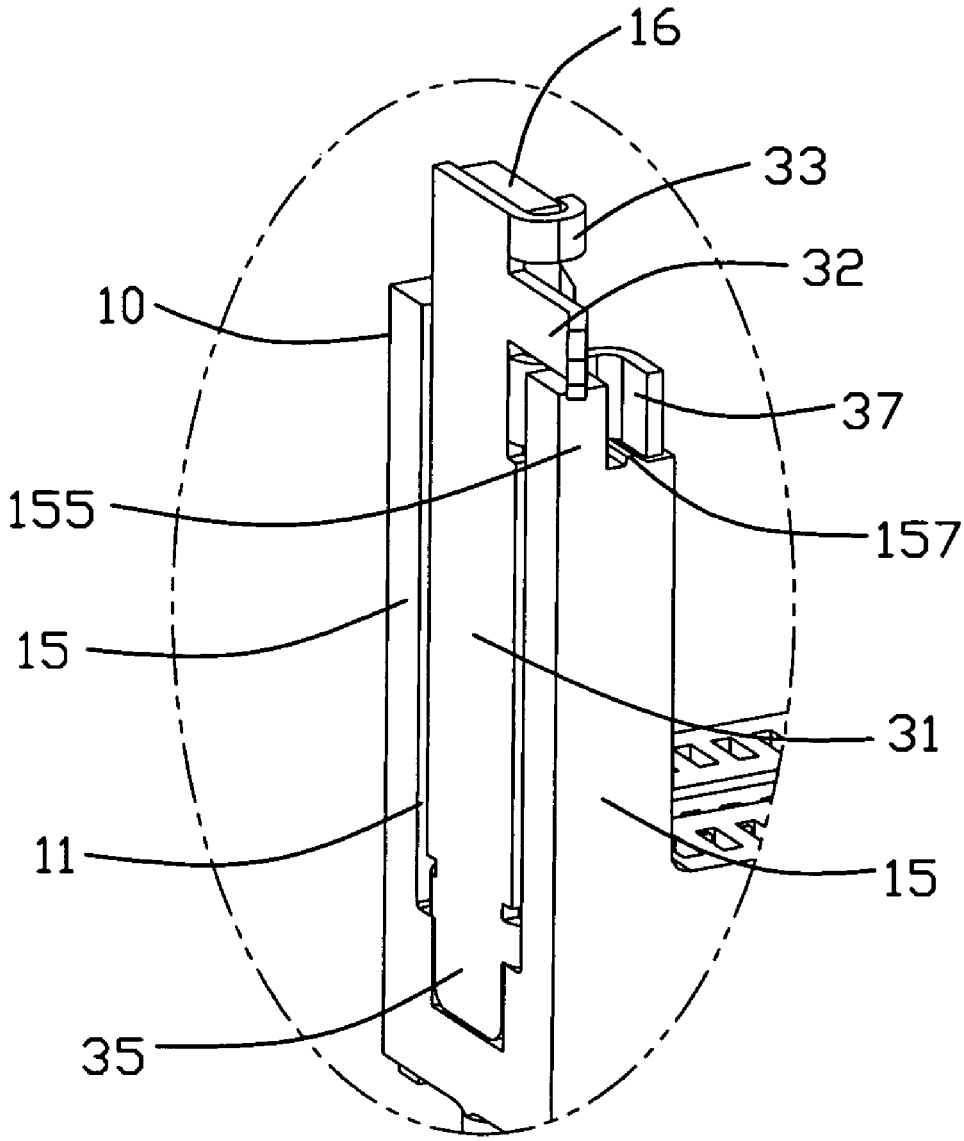
FIG. 3 is a partly enlarged view taken from the circle A shown in FIG. 1.
Figure 4:
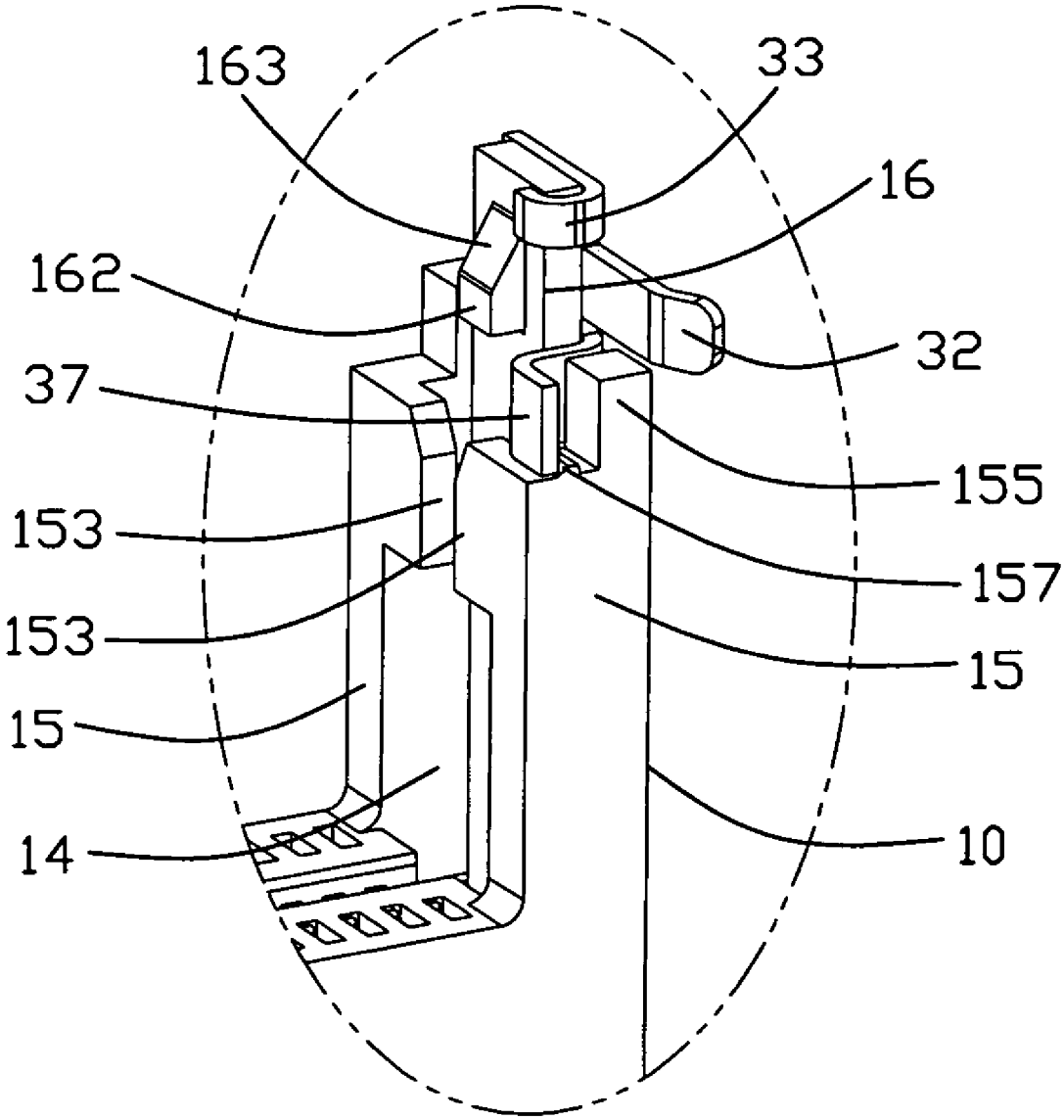
FIG. 4 is a partly enlarged view taken from the circle B shown in FIG. 1.

Referring to FIGS. 2-4, the latches or reinforcement pieces 3 are made of metallic materials. Each latch 3 includes an elongated base 31 having a foot portion 35 extending from a low end thereof for cooperating with the slot 17 of the arm portion 10. The foot portion 35 has a pair of positioning portion 356 extending from opposite sides thereof for fixing to the arm portion 10. The latch 3 moves with the resilient arm 16 when the latch 3 is assembled to the insulative housing 1. A U-shaped enclosure 33 is formed on a top end of the base 31 opposite to the foot portion 35 for clasping the free end of the resilient arm 16. A stopping plate or stopper 37 extends from a side of the base 31 so as to abut against the projection 157 for positioning the resilient arm in an open state so that the memory module 200 can be detached from the connector 100 easily. The latch 3 further has a gripping portion 32 extending from the same side with the stopping plate 37 for facilitating urging the resilient arm 16.

Referring to FIGS. 1-4, in assembling the memory module 200 to the card edge connector 100, a bottom edge of the memory module 200 is firstly inserted into the receiving slot 12 through the inclined faces 163 of the retaining embossments 162. The stopping plates 37 can be orientated stably by abutting against an inner face of the projections 157 thereby preventing deformation or breakage of the resilient arm 16. The retaining embossments 162 of the resilient arms 16 is cooperated with cutouts 201 of the memory module 200 so as to retain the memory module 200 in the receiving slot 12.

When removing the memory module 200, the gripping portions 32 are pulled outwardly and driving the free end of the resilient arms 16 away from each other to release the memory module 200. Because the limiting portion 155 can prevent overmovement of the stopping plate, the stopping plates 37 are moved over the projections 157 and restrained between the projections 157 and the limiting portions 155. When the gripping portions 32 are released, the stopping plates 37 abut against an outer face of the projections 157 and can not go back to the original positions. Therefore, the pair of resilient arms 16 are opened and the memory module 200 is easy to be removed therefrom.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for receiving a module, comprising:

an insulative housing having a receiving slot for receiving the module and a pair of arm portions located at opposite ends thereof, each arm portion having a pair of side walls and a resilient arm with a retaining embossment for locking the module, the side walls being integrally formed on the insulative housing and including a projection;

a plurality of terminals mounted on said insulative housing and extending into the receiving slot thereof; and a pair of latches attached to the arm portions and moving with the resilient arms, each latch including a base and a stopping plate extending from the base;

said stopping plates engaging with said projections of the side walls thereby opening said resilient arms when the module detaches from the card edge connector.

2. The card edge connector as claimed in claim 1, wherein the side wall has a limiting portion spaced from the projection, and said stopping plate can be opened to be restrained between the projection and the limiting portion.

3. The card edge connector as claimed in claim 1, wherein the pair of side walls define a retaining slot therebetween for communicating with the receiving slot.

4. The card edge connector as claimed in claim 3, wherein each side wall has a project portion protruding into the retaining slot and located inside the resilient arm.

5. The card edge connector as claimed in claim 1, wherein the resilient arm is integrally formed on the insulative housing.

6. The card edge connector as claimed in claim 1, wherein the resilient arm is assembled to the insulative housing.

7. The card edge connector as claimed in claim 1, wherein said latch has a U-shaped enclosure at a top end thereof for clasping a free end of said resilient arm.

8. The card edge connector as claimed in claim 1, wherein said arm portion comprises a slot, and the base of said latch has a foot portion at a low end for engaging with the slot and a pair of positioning portions extending from the foot portion for fixing to the arm portion.

9. The card edge connector as claimed in claim 1, wherein said latch further includes a gripping portion at a top end thereof for urging said resilient arm.

10. A card edge connector comprising:

an elongated insulative housing having a pair of arm portions at opposite ends thereof, each arm portion having a pair of side walls defining a retaining slot for receiving a module therein, and a resilient arm located between the side walls, the resilient arm comprising a retaining embossment for locking the module, the side wall including a projection;

a plurality of terminals assembled to said insulative housing; and a pair of metal latches attached to the arm portions and each having a base and a pair of positioning portions at opposite sides thereof for fixing to the corresponding arm portion and the latch including a stopping plate engaging with said projection for limiting inward movement of the resilient arm when said resilient arm is opened; wherein each latch has a gripping portion at a top end thereof for urging the corresponding resilient arm.

11. The card edge connector as claimed in claim 10, wherein each latch has a U-shaped enclosure formed on an end of the base for clasping a free end of the corresponding resilient arm.

12. The card edge connector as claimed in claim 10, wherein said resilient arms are assembled to said insulative housing.

13. The card edge connector as claimed in claim 10, wherein said resilient arms are unitarily formed on said insulative housing.

14. An electrical connector for use with a memory module, comprising:

an insulative housing extending along a longitudinal direction, in a front view thereof, with a central slot formed therein for receiving the memory module;

a pair of resilient arms unitarily extends from two opposite longitudinal ends of the housing in a direction away from the central slot, the arms being respectively equipped with locking heads located around free ends of the corresponding resilient arms and laterally extending toward each other;

a pair of metallic reinforcement pieces respectively assembled to the opposite longitudinal ends and respectively grasping the corresponding resilient arms;

the housing including a pair of side walls which define a retaining passage therebetween around each of the longitudinal ends, the retaining passage communicating with the central slot, each of the side walls having a projection portion protruding into the retaining passage so as to not only confine the memory module therein without lateral movements after the memory module is assembled to the housing but also guide insertion of the memory module into the central slot in only a vertical; wherein the reinforcement piece is outwardly deflected along with the corresponding resilient arm, and vice versa.

15. The electrical connector as claimed in claim 14, wherein at each of the longitudinal ends, at least one of the corresponding reinforcement piece and the resilient arm defines gripping portion.

16. The electrical connector as claimed in claim 15, wherein the gripping portion extends in a lateral direction angled with the vertical direction in a side view of the housing.

17. The electrical connector as claimed in claim 14, wherein the locking head is equipped with an inclined top face for facilitating insertion of the memory module into the housing in the vertical direction.

18. The electrical connector as claimed in claim 14, wherein the reinforcement piece defines a stopper outwardly abutting, in the longitudinal direction, against the housing around the corresponding longitudinal end for preventing over-deflection of the reinforcement piece and the corresponding resilient arm when the resilient arm is outwardly deflected to an outer deflected position.

19. The electrical connector as claimed in claim 14, wherein the housing defines a projection and the reinforcement defines a stopper inwardly abutting against the projection, in the longitudinal direction, around the corresponding longitudinal end for temporarily holding the reinforcement piece and the associated resilient arm at an outer deflected position so as to facilitate withdrawal of the memory module from the housing after the memory module is assembled into the housing.

* * * * *